United States Patent [19]

Shaw

[11] Patent Number: 4,747,280

[45] Date of Patent: May 31, 1988

[54] LOCK DEVICE

[75] Inventor: Charles R. Shaw, Twinsburg, Ohio

[73] Assignee: Esmet, Inc., Canton, Ohio

[21] Appl. No.: 40,087

[22] Filed: Apr. 20, 1987

[51] Int. Cl.[4] ..... E05B 47/00

[52] U.S. Cl. ..... 70/279; 70/58; 70/62; 70/277; 211/8; 211/64

[58] Field of Search ..... 70/14, 19, 57, 58, 61, 70/62, 237, 275, 277, 279, 280; 211/4, 8, 9, 64

[56] References Cited

U.S. PATENT DOCUMENTS

| | | | |
|---|---|---|---|
| 2,316,995 | 4/1943 | Smith | 211/64 X |
| 2,668,645 | 2/1954 | Pease | 70/62 X |
| 3,200,623 | 7/1963 | Peters | 70/279 |
| 3,241,344 | 3/1966 | Peters | 70/279 |
| 3,326,385 | 6/1967 | Pinkerton et al. | 211/64 X |
| 3,543,547 | 12/1970 | Sugiyama | 70/277 |
| 3,767,093 | 10/1973 | Pinkerton et al. | 211/64 X |
| 3,796,073 | 3/1974 | Guiraud | 70/134 |
| 3,802,612 | 4/1974 | Smith | 211/8 X |
| 3,835,678 | 9/1974 | Meyer et al. | 70/241 |
| 3,917,071 | 11/1975 | Walters | 211/64 |
| 4,099,752 | 7/1978 | Geringer | 292/144 |
| 4,132,315 | 1/1979 | Young | 211/64 X |
| 4,364,499 | 12/1982 | McCue | 211/64 X |
| 4,426,864 | 1/1984 | Morikawa | 70/431 |
| 4,615,548 | 10/1986 | McGee | 292/144 |
| 4,648,638 | 3/1987 | McKnight | 70/279 X |
| 4,651,544 | 3/1987 | Hungerford | 70/279 X |

FOREIGN PATENT DOCUMENTS

| | | | |
|---|---|---|---|
| 2605831 | 8/1977 | Fed. Rep. of Germany | 70/19 |

*Primary Examiner*—Robert L. Wolfe
*Assistant Examiner*—Suzanne L. Dino
*Attorney, Agent, or Firm*—Michael Sand Co.

[57] ABSTRACT

A security lock for retaining a weapon in a storage rack can be operated either electrically by a remote switch or mechanically by a key. The weapon is locked to a main body by a lid which is pivotally mounted by a hinge and pivot pin on the body. The plunger of a solenoid extends into a slot formed in the pivot pin preventing it from rotating when the lid is in a locked position and the solenoid deenergized. A key actuated detent locks the pivot pin to the lid when the detent is in key locked position. Actuation of the solenoid retracts the plunger permitting the lid to pivot to open position without operating the key operated detent which maintains the pivot pin locked to the lid. Retraction of the key operated detent unlocks the pivot pin from the lid to enable the pivot pin to be slid axially along the hinge to disengage the solenoid plunger from the pivot pin slot permitting the lid to move to open position without energizing the solenoid.

17 Claims, 3 Drawing Sheets

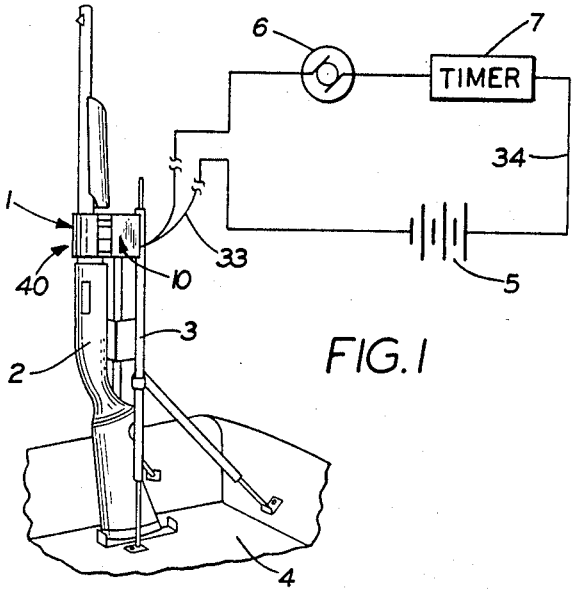
FIG. 1
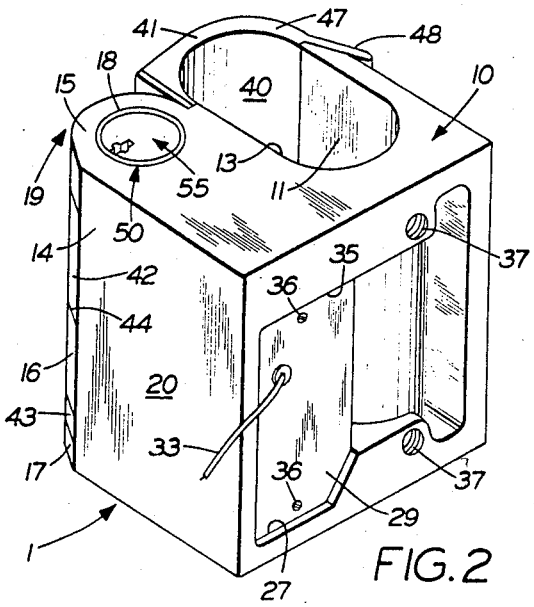
FIG. 2
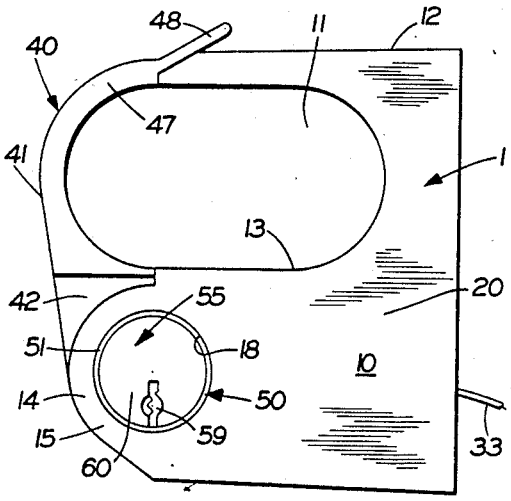
FIG. 5
FIG. 6
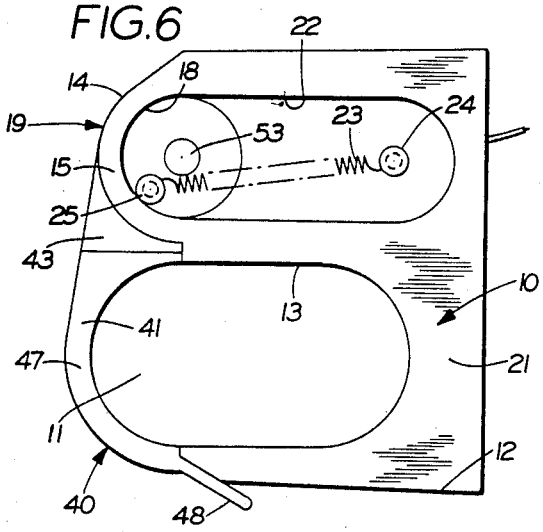
FIG. 7
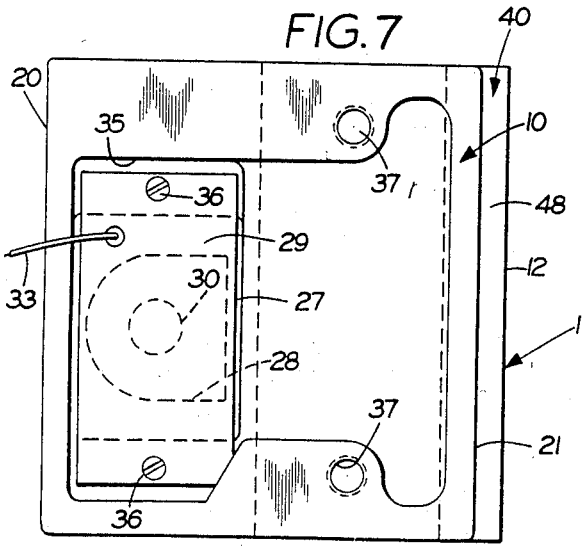
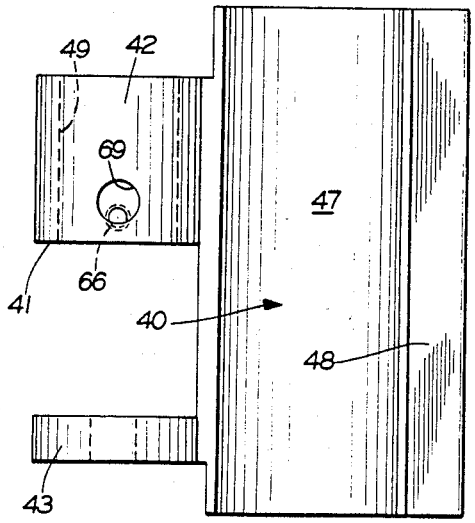
FIG. 16

LOCK DEVICE

TECHNICAL FIELD

The invention relates to a lock device and in particular to a lock device for securing a weapon in a storage rack. More particularly, the invention relates to such a lock device which can be operated independently, both electrically and mechanically for unlocking the device.

BACKGROUND ART

Weapons, primarily rifles, shotguns and the like, are maintained by law enforcement agencies in secured storage position and in particular storage racks. Most patrolmen in vehicles have a shotgun installed in a security rack that is mounted in the front seat of the vehicle with the rack being bolted to the floor of the vehicle and the shotgun being locked in the storage rack. Most of these guns are locked in the rack by an electric gun lock which has a release switch usually mounted in a concealed place beneath the dashboard of the vehicle. This enables the patrolman to manually actuate the switch which will automatically unlock the lock enabling the gun to be removed rapidly from the rack in emergency situations. Many of these electric gun locks include a timer which automatically relocks the lock after a predetermined amount of time, usually several seconds, preventing removal of the gun.

Although these existing electric gun locks do perform satisfactorily, they possess one serious problem. The lock cannot be opened by the patrolman should the vehicle suddenly lose power because of battery failure if the vehicle is in a wreck or because of other vehicle malfunction. This could place the patrolman in a difficult position, especially if an emergency was developing at the time of power loss. Therefore, it is desirable that such gun locks be provided with a manually actuated unlocking mechanism which will enable the patrolman to unlock the lock to remove the weapon even though there is no power to the normally operated electric lock.

Thus, it is desirable to provide a security lock for a gun rack which can be operated by the usual electric switch and, in addition, can be mechanically unlocked by a key independent of the electrical locking mechanism thereby enabling the patrolman a secondary means to remove his weapon from the locked rack in the event of power failure in the vehicle.

There are various prior art locking systems which can be operated both electrically and mechanically such as shown in U.S. Pat. Nos. 3,200,623, 3,241,344, 3,796,073, 3,835,678, 4,099,752, 4,426,864, and 4,615,548. However, most of these systems are expensive and complicated mechanisms which would not be suitable or practical for incorporation into a lock used for securing a weapon in a storage rack.

DISCLOSURE OF THE INVENTION

Objectives of the invention include providing an improved lock device primarily for use in securing a weapon in a storage rack which can be operated both mechanically and electrically to unlock the device, in which each mode of operation is independent of the other mode, and in which the device enables a patrolman to remove the weapon from the rack even in the event of power failure in the vehicle while providing complete security against unauthorized removal of the gun from the rack even should the locking mechanism be forcibly damaged.

Another objective is to provide such a lock device which is relatively pick-proof, in which the mechanically operated lock cylinder, even if removed by a sledge hammer, will not release its pop-out lock mechanism, and in which the lock is of a simple, rugged and relatively inexpensive construction which uses the general principle and features of existing electric locks, yet which provides the mechanical unlocking feature as a part thereof.

Another objective is to provide such a lock device in which the electrical operating switch for the lock can be concealed in the vehicle at a location within easy reach of the driver or passenger of the vehicle, yet which is not readily visible to an intruder, in which the device can be provided with a usual timer circuit to cancel the open actuation of the device after a predetermined passage of time, in which the device locks a locking cover at the hinge end thereof eliminating the need of a standard sliding bolt and strike plate combination present in most locking devices, in which the device has a solenoid actuated plunger that is concelaed entirely within the body of the lock and is unaccessible to an intruder, and in which the device can be used for other security applications in addition to the retaining of a weapon in a vehicle mounted storage rack.

These objectives and advantages are obtained by the improved lock device of the invention, the general nature of which may be stated including a lock body; lid means for locking an object on the body; a pivot pin means for pivotally mounting the lid means on the lock body for movement between locked and unlocked positions; said pivot pin means being slidably mounted with respect to the lid means and rotationally mounted with respect to the body; mechanically actuated first detent means for locking the pivot pin means to the lid means; and electric actuated second detent means for locking the pivot pin means from rotation with respect to the body, whereby mechanical actuation of the first detent means unlocks the pivot pin means from the lid permitting the pivot pin means to slide out of locked engagement with the second detent means permitting the lid means to be moved to the unlocked position, and whereby electric actuations of the second detent means unlocks the pivot pin means from the body permitting the lid means to be moved to the unlocked position.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

FIG. 1 is a diagrammatic perspective view showing one installation with which the improved security lock device of the invention may be used;

FIG. 2 is an enlarged perspective view of the improved lock device of FIG. 1;

FIG. 5 is a side elevational view of the lock device in closed position;

FIG. 6 is an elevational view of the opposite side of the lock device of FIG. 5;

FIG. 7 is a bottom plan view of the lock device of FIGS. 5 and 6;

FIG. 16 is a plan view of the inside surface of the locking lid.

Similar numerals refer to similar parts throughout the drawings.

BEST MODE FOR CARRYING OUT THE INVENTION

Figures 3, 4:
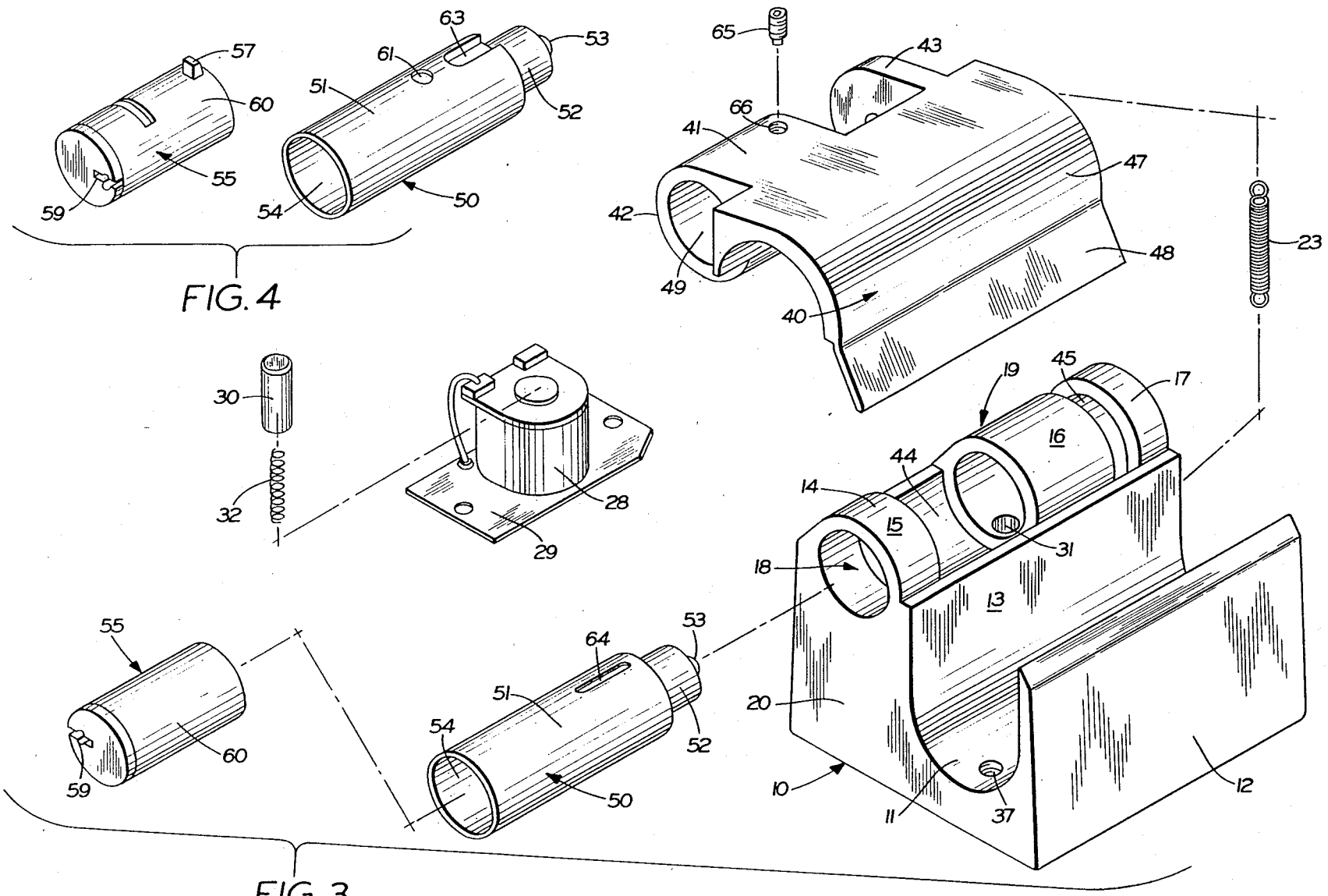
FIG. 3 is an enlarged exploded perspective view of the various components of the lock device of FIG. 2.
FIG. 4 is an exploded perspective view of the hinge pin and lock cylinder rotated 180 degrees from the position shown in FIG. 3.

The improved lock device of the invention is indicated generally at 1, and is shown particularly in FIG. 2 with the principle components thereof being shown in FIG. 3. Lock device 1 is shown securing a weapon 2 in a usual type of storage rack 3 which is bolted to the floor 4 of a vehicle. It is understood that lock device 1 may be used for other types of installations than that shown particularly in FIG. 1 without affecting the concept of the invention.

The usual electric circuitry for actuating the electrical locking mechanism of device 1 is also shown in FIG. 1. The circuitry includes a battery 5, which usually will be the vehicle battery, an actuating button 6 which is usually concealed beneath the dashboard of a vehicle yet readily accessible by the driver or front seat passenger of the vehicle, and a timer 7 whereby the electrical control mechanism wil be deactivated after a predetermined passage of time.

Referring particularly to FIG. 3, lock device 1 includes a lock body indicated generally at 10, preferrably formed of a cast aluminum, which has a weapon receiving slot-like opening 11 formed therein defined by an outer upstanding wall 12 and an inner wall 13. Body 10 includes a wing 14 of a usual hinge assembly indicated generally at 19. Wing 14 is formed integrally with wall 13 and has three hollow cylindrical hinges forming components 15, 16 and 17 which form in combination an axially extending bore indicated generally at 18. Body 10 further includes a side wall 20 and an opposite side wall 21 (FIG. 10) which is formed with an elongated cavity 22 containing a coil tension spring 23 extending between bolts 24 and 25. The function of spring 23 is described in greater detail below.

Figure 10:
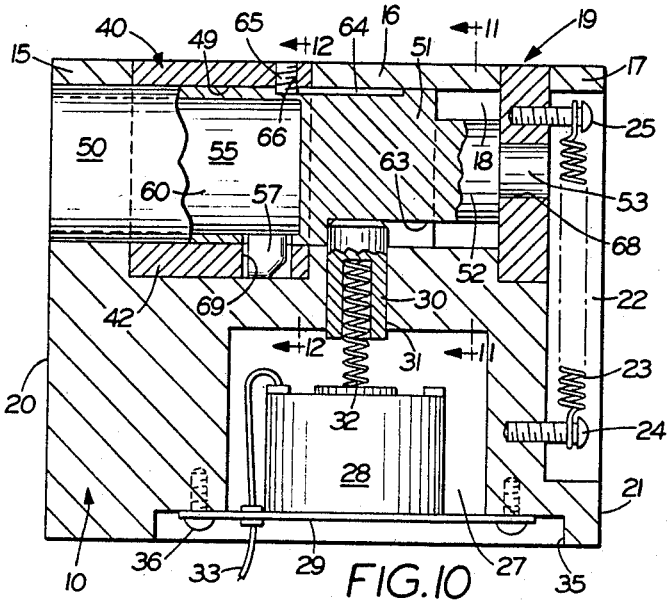
FIG. 10 is an enlarged sectional view taken on line 10—10, FIG. 8, showing the lock device in locked positions, both mechanically and electrically.
Figure 11:
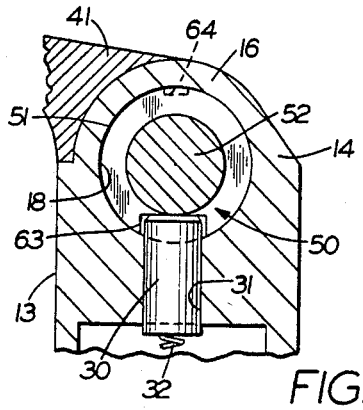
FIG. 11 is an enlarged fragmentary sectional view taken on line 11—11, FIG. 10, showing the solenoid plunger engaged with the hinge pin.
Figure 15:
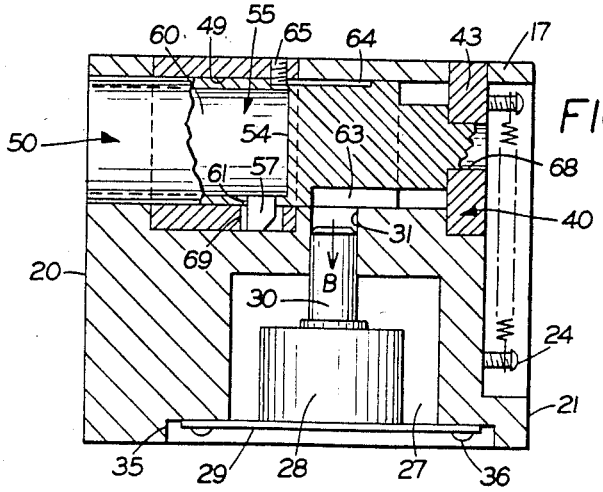
FIG. 15 is a sectional view showing the lock device in an electrically unlocked position.

Referring to FIGS. 10 and 15, a cavity 27 is formed in body 10 having a usual solenoid 28 mounted therein by a plate 29. Solenoid 28 includes a plunger 30 which extends upwardly through a complementary shaped hole 31. Plunger 31 is spring-biased upwardly as shown in FIG. 10 by a compression coil spring 32. Wires 33 connect solenoid 28 to vehicle battery 5 which is connected by wires 34 to timer 7 and switch 6 as shown in FIG. 1. Plate 29 is secured in a cutout 35 formed in the bottom of body 10 by a plurality of bolts 36 engaged in threaded holes formed in the bottom of the body 10 (FIG. 10). A plurality of other threaded holes 37 are formed in the bottom of body 10 (FIGS. 2 and 7) for mounting device 1 on a supporting structure, usually a mounting plate. Thus, unauthorized access to solenoid 28 is denied upon the mounting of device 1 on a support plate or structure.

Figure 9:
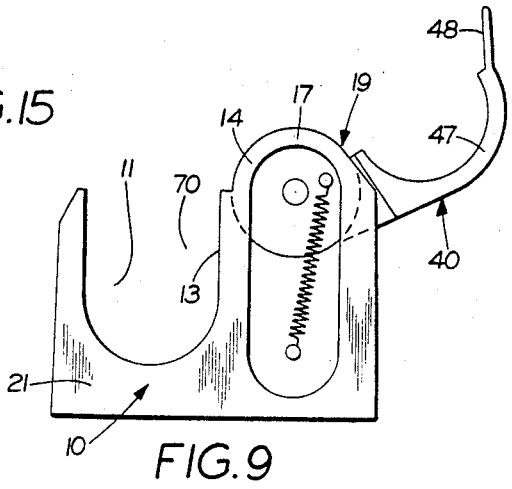

Referring to FIGS. 3 and 16, a locking lid indicated generally at 40, which preferrably is formed of lightweight cast aluminum, is provided with the other wing 41 of hinge assembly 19. Wing 41 has a pair of integrally formed hollow cylindrical hinge sections 42 and 43 which are inserted into complementary shaped openings 44 and 45 as shown in FIG. 3 and FIG. 10. Opening 44 is formed between hinge components 15 and 16 and opening 45 is formed between hinged components 16 and 17. Locking lid 40 includes a arcuate-shaped cover plate 47 which terminates in an angled end flange 48, shown particularly in FIG. 5 and 6, which provides a means of easily grasping the lid and moving it to the open position as shown in FIG. 9 after the lid is unlocked, either electrically or mechanically by the improved mechanism of the invention. Hinge component 42 is formed with a bore 49 which axially aligns with bore 18 of wing 14 when lid 40 is pivotally mounted on body 10.

Figure 12:
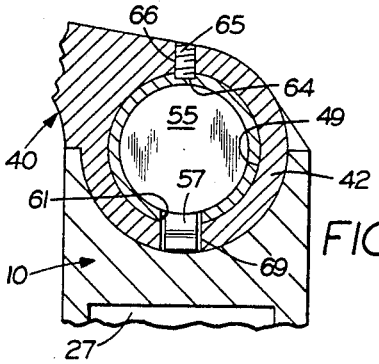
FIG. 12 is an enlarged fragmentary sectional view taken on line 12—12, FIG. 10, showing the key actuated detent engaged with the lid.

In accordance with one of the features of the invention, a hinge pin indicated generally at 50 and shown particularly in FIG. 4, is slidably mounted within aligned bores 18 and 49 of body 10 and locking lid 40, respectively, to pivotally mount lid 40 on body 10. Hinge pin 50 is cylindrically shaped having a main body portion 51, a reduced diameter intermediate stepped cylindrical portion 52, and a further reduced cylindrical end portion 53. Main body portion 51 is generally hollow throughout having an interior 54 in which a lock cylinder indicated generally at 55, is slidably received. Lock cylinder 55 is a usual component having a reciprocal locking detent 57 actuated by a key 58 (FIGS. 13 and 14) insertable into a keyhole 59. The construction and operation of locking cylinder 55 is well known in the art and therefore is not described in detail. Rotation of key 58 in heyhole 59 reciprocates locking detent 57 inwardly and outwardly from main housing 60 of cylinder 55. Detent 57 projects through a hole 61 formed in hinge pin 50 (FIGS. 4 and 12).

Figure 13:
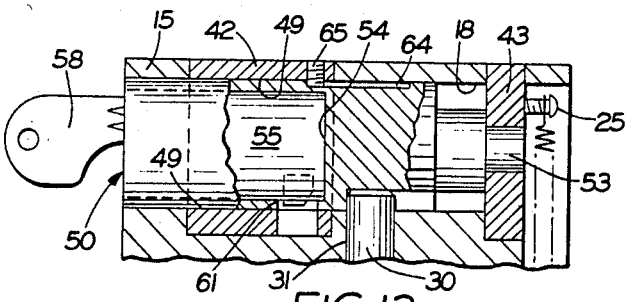
FIG. 13 is an enlarged fragmentary sectional view showing the cylinder lock in the mechanically unlocked position, which permits the lid to rotate with respect to the cylinder lock and body.
Figure 14:
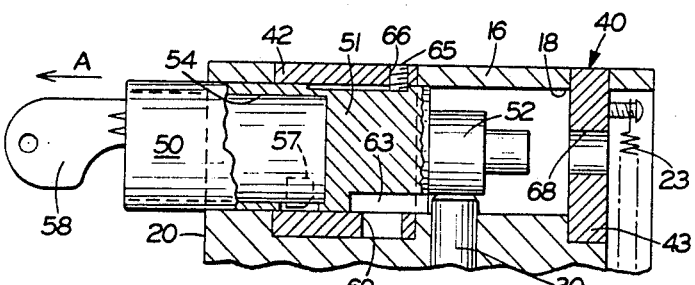
FIG. 14 is a fragmentary sectional view similar to FIG. 13 showing the mechanical unlocking of the cylinder bypassing the locking mechanism of the solenoid plunger.

An axially extending slot 63 is formed on the inner end of main body portion 51 of hinge pin 50, the bottom wall of which aligns with the outer surface of intermediate cylindrical portion 52 as shown in FIGS. 13–15. This provides for a smooth continuous sliding surface along the bottom wall of slot 63 onto intermediate portion 52 for movement of solenoid plunger 30 as described below. An elongated groove 64 (FIGS. 3, 10 and 12) is formed in main body 51 of hinge pin 50 diametrically opposite hole 61 and slot 63, for receiving the inner end of a set screw 65 which extends through a threaded hole 66 formed in hinge wing component 42 of lid 40 (FIGS. 3 and 12). Set screw 65 maintains hinge pin 50 within bore 49 of lid 40 and insures alignment of locking detent 57 of cylinder 55 with hole 61.

The outer diameter of main body portion 51 of hinge pin 50 is complementary to the inner diameter of bore 18 of hinge wing members 15 and 16 of body 10 and to bore 49 of hinge component 42 of locking lid 40 to provide a smooth pivotal movement of the locking lid thereon. Outer stepped end 53 of hinge pin 50 is slidably received in a complementary-shaped hole 68 (FIGS. 13–15) formed in cylindrical hinge components 17 of body 10 to provide additional support for hinge pin 50 when it is in a completely locked position as shown in FIG. 10.

When in assembled position, detent 57 of lock cylinder 55 projects through hole 61 of hinge pin 50, and when the device is in the mechanically locked position as shown in FIGS. 10 and 15, detent 57 projects into a hole 69 formed in hinge component 42 of locking lid 40 to mechanically lock hinge pin 50 to lid 40. Set screw 65 is engaged in groove 64 to retain hinge pin 50 within hinge assembly 19 upon the outward sliding movement thereof when mechanically unlocking device 1 as described below.

Figure 8:
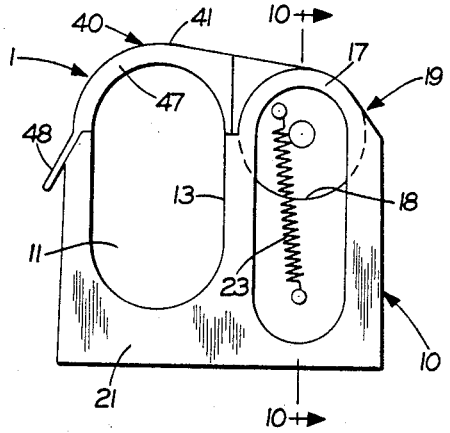
FIGS. 8 and 9 are side elevational views of the lock device shown in closed and open positions, respectively.

When device 1 is in the fully locked position as shown particularly in FIGS. 8 and 10, locking lid 40 closes open side 70 (FIG. 9) of body slot 11 preventing the removal of a gun or other weapon therefrom. Spring 23 is mounted in an overcenter relationship by the positioning of mounting bolt 25 on hinge component 17 biasing lid 40 to remain in the closed position to prevent rattling of the lid against the body when in the closed position. This overcenter mounting arrangement of bolt 25 and spring 23 also will cause spring 23 to bias lid 40 to remain in the open position as shown in FIG. 9.

In the locked position as shown in FIG. 10, detent 57 extends into hole 69 of lid hinge component 42 to lock hinge pin 50 to lid 40.

Solenoid spring 32 will bias plunger 30 upwardly through hole 31 and into slot 63 of hinge pin 50. In this arrangement hinge pin 50 is prevented by detent 57 from sliding axially with respect to hinge bore 18 and the hinge pin also is prevented from rotation by solenoid plunger 30. Since lid 40 is locked to hinge pin 50 by detent 57 and pin 50 is prevented from rotation by plunger 30, lid 40 is prevented from rotation with respect to body 10 and is secured in the locked closed position.

To mechanically operate lock device 1 with key 58, the key is inserted into keyhole 59 and rotated which will retract detent 57 into lock cylinder housing 60 as shown in FIGS. 13 and 14, and out of engagement in hole 69 of lid 40. By pulling outwardly in the direction of arrow A on lock 58, hinge pin 50 will slide axially within bores 18 and 49 from the position of FIG. 13 to that of FIG. 14 whereby solenoid plunger 30 will become disengaged from within hinge pin slot 63. Plunger spring 32 will bias plunger 30 into engagement with the outer cylindrical surface of intermediate stepped portion 52 of pin 50 as shown in FIG. 14, preventing continued movement of plunger 30. Upon hinge pin 50 reaching the position of FIG. 14, locking lid 40 is free to rotate from the position of FIG. 8 to that of FIG. 9 due to the disengagement of plunger 30 from within slot 63 enabling a weapon to be removed from within slot opening 11 of body 10.

To lock the device, lid 40 is pivoted from the open position of FIG. 9 to the closed position of FIG. 8 and hinge pin 50 is slid inwardly from the position of FIG. 14 to the position of FIG. 13. Solenoid plunger 30 will enter slot 63 upon pin 50 reaching its locked position by the alignment provided by set screw 65. Lock cylinder 55 is then rotated by key 58 moving detent 57 back into hole 69 of lid 40.

To electrically operate device 1, solenoid 28 is energized causing plunger 30 to move from the position of FIG. 10 to that of FIG. 15 in the direction of arrow B. This disengages plunger 30 from within slot 63 of pin 50 enabling lid 40 to be rotated from the closed position of FIG. 8 to that of FIG. 9. The continued engagement of locking detent 57 in hole 69 of lid 40 does not affect this pivotal movement of the lid since the coupled lid and hinge pin merely rotate in unison in bore 18 of body 10. Upon return of lid 40 to the closed position of FIG. 8, solenoid plunger 30 will automatically move into slot 63 by the biasing action of spring 32 locking the lid in closed position.

Thus, improved locking device 1 contains both mechanical and electrical actuated mechanisms for unlocking cover lid 40, which mechanisms operate completely independent of each other and are unaffected by the relative position of either at the time of actuation. Furthermore, nearly all of the main components of the mechanisms are housed completely within body 10 or in hinge assembly 19 which joins lid 40 with body 10, making such components relatively unaccessible to an unauthorized intruder. Also, even if the mechanical locking mechanism provided by cylinder 55 is completely destroyed, the lid will not be moveable to the open position due to the continuous engagement of solenoid plunger 30 in slot 63 of hinge pin 50.

Accordingly, the improved lock device of the invention is simplified, provides an effective, safe, inexpensive, and efficient device which achieves all the enumerated objectives, provides for eliminating difficulties encountered with prior lock devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved lock device is constructed and used, the characteristics of the device, and the advantageous, new and useful results obtained; the new and useful structures, elements, arrangements, parts and combinations, are set forth in the appended claims.

What is claimed is:

1. A lock device operated independently, electrically and mechanically including:

(a) a lock body;

(b) lid means for locking an object on the body, pivotally movable between locked and unlocked positions;

(c) hinge pin means for pivotally mounting the lid means on the lock body, said hinge pin means being slidably mounted with respect to the lid means and rotationally mounted with respect to the body;

(d) mechanically actuated first detent means for locking the hinge pin means to the lid means; and (e) electrically actuated second detent means for locking the hinge pin against rotation with respect to the body, whereby mechanical actuation of the first detent means unlocks the hinge pin means from the lid means permitting said pin means to be slid out of locked engagement with the second detent means permitting the lid means to be moved to the unlocked position, and whereby electrical actuation of the second detent means unlocks the hinge pin means from the body permitting the lid to be moved to the unlocked position with the first detent means maintaining the hinge pin means locked to the lid means.

2. The lock device defined in claim 1 in which the lock body has an open sided slot for receiving an object therein; and in which the lid means opens and closes said open side of the slot when in the unlocked and locked position, respectively.

3. The lock device defined in claim 2 in which the body is formed with one wing of a hinge assembly and the lid means is formed with the other wing of the hinge assembly; and in which the hinge pin means is engaged with the wings when said wings are in an aligned position to pivotally mount the lid means on the body.

4. The lock device defined in claim 3 in which the hinge pin means is a generally cylindrical shaped pin, in which the first detent means is a key actuated detent mounted in a lock cylinder located in an open end of the hinge pin; and in which said detent projects through a hole formed in the hinge pin and into a hole formed in the wing of the lid means for locking the hinge pin to the lid means.

5. The lock device defined in claim 4 the second detent means is a solenoid plunger; and in which the plunger extends into an open ended slot formed in the hinge pin whereby the sliding movement of the hinge pin disengages the plunger from the slot enabling said pin to rotate with respect to the lock body.

6. The lock device defined in claim 5 in which the plunger is spring biased into the hinge pin slot; and in which actuation of the solenoid retracts the plunger from the slot.

7. The lock device defined in claim 5 in which the hinge pin has a first stepped cylindrical portion with a diameter complementary to a bottom surface of the plunger receiving slot.

8. The lock device defined in claim 7 in which the hinge pin has a second stepped cylindrical portion engageable in an opening formed in the said one wing of the lid means.

9. The lock device defined in claim 1 in which spring means biases the lid to remain in open position.

10. The lock device defined in claim 1 in which retention means is engaged with the hinge pin means to limit the sliding movement of said pin means with respect to the lid means.

11. The lock device defined in claim 10 in which the retention means is a set screw extending through an opening formed in the lid means and terminating in a groove formed in the hinge pin means.

12. The lock device defined in claim 1 in which the second detent means includes an electric solenoid mounted in the lock body and a solenoid actuated plunger extending through a hole formed in said body and into a slot formed in the hinge pin means.

13. A lock device for securing a weapon in a rack including:

(a) a lock body having a weapon receiving slot form therein;

(b) a lid pivotably mounted on the body and movable between a closed position wherein said lid closes the slot to prevent a weapon from being removed from the body, and an open position wherein said lid permits the weapon to be removed from the body slot;

(c) a hinge pin pivotably mounting the lid on the lock body, said hinge pin being slidably mounted with respect to said lid and body;

(d) a lock cylinder mounted in the hinge pin and having a key actuated locking detent, wherein said detent when in an extended position, secures the hinge pin to the lid preventing sliding movement therebetween; and (e) an electric solenoid actuated plunger mounted in the body and moveable between an extended position wherein said plunger engages the hinge pin to prevent rotation of said hinge pin and lid to the open position when the key actuated locking detent is in the extended position, and a retracted position wherein the plunger is disengaged from the hinge pin whereby the lid can be pivoted to the open position, and wherein movement of the key actuated locking detent to a retracted position disengages the hinge pin from the lid permitting sliding movement of the hinge pin with respect to the lid causing disengagement of the solenoid locking pin from locking engagement with the hinge pin whereby the lid can be rotated to the open position.

14. The lock device defined in claim 13 in which the hinge pin is formed with a slot; and in which the solenoid plunger extends into the slot to prevent rotation of the hinge pin.

15. The lock device defined in claim 14 in which the hinge pin has a reduced diameter stepped cylindrical portion the surface of which aligns axially with a bottom surface of the slot.

16. The lock device defined in claim 13 which a tension coil spring extends between the lock body and lid and is connected to the lid in an off-center relationship to bias the lid to remain in the open and closed positions upon reaching said positions.

17. The lock device defined in claim 13 in which the key actuated locking detent projects through a hole formed in the hinge pin and into an aligned hole formed in the lid to secure the hinge pin to the lid when the detent is in the extended position.

* * * * *